US006039009A

United States Patent [19]

Hirose

[11] Patent Number: 6,039,009

[45] Date of Patent: Mar. 21, 2000

[54] ENGINE-OPERATED GENERATOR

[75] Inventor: Tadafumi Hirose, Wako, Japan

[73] Assignee: Honda Giken Kogyo Kabushiki Kaisha, Tokyo, Japan

[21] Appl. No.: 09/121,432

[22] Filed: Jul. 23, 1998

[30] Foreign Application Priority Data

Jul. 24, 1997 [JP] Japan ..... 9-198669

[51] Int. Cl.[7] ..... F02B 63/00

[52] U.S. Cl. ..... 123/2; 123/41.7; 290/1 B; 181/204

[58] Field of Search ..... 123/2, 41.56, 41.7; 181/204; 290/1 A, 1 B; 180/68.1

[56] References Cited

U.S. PATENT DOCUMENTS

| | | | |
|---|---|---|---|
| 3,259,752 | 7/1966 | Honda . | |
| 4,495,901 | 1/1985 | Nannini et al. | 123/2 |
| 4,595,841 | 6/1986 | Yaguchi . | |
| 4,608,946 | 9/1986 | Tanaka . | |
| 4,622,923 | 11/1986 | Nishimura et al. | 123/2 |
| 4,698,975 | 10/1987 | Tsukamoto et al. | 60/721 |
| 4,702,201 | 10/1987 | Odo et al. | 123/2 |
| 4,721,070 | 1/1988 | Tanaka et al. | 123/2 |
| 4,835,405 | 5/1989 | Clancey et al. | 290/1 A |
| 4,859,886 | 8/1989 | Tanaka . | |
| 4,907,546 | 3/1990 | Ishii et al. | 123/41.56 |
| 5,121,715 | 6/1992 | Nogami et al. | 123/41.7 |
| 5,125,378 | 6/1992 | Westerbeke, Jr. | 123/198 E |
| 5,433,175 | 7/1995 | Hughes et al. | 123/2 |
| 5,575,349 | 11/1996 | Ikeda et al. | 180/68.1 |
| 5,642,702 | 7/1997 | Konchi et al. | 123/198 E |
| 5,899,174 | 5/1999 | Anderson et al. | 123/2 |

FOREIGN PATENT DOCUMENTS 2-5068 2/1990 Japan .

*Primary Examiner*—Noah P. Kamen
*Assistant Examiner*—Hai Huynh
*Attorney, Agent, or Firm*—Carrier, Blackman, & Associates, P.C.; William D. Blackman

[57] ABSTRACT

A compact engine-operated generator unit has instruments in a soundproof case arranged efficiently from the viewpoint of measures for sound and heat abatement. Particularly, the engine-operated generator unit includes the engine and the generator driven by the engine arranged in a direction of a rotary shaft linking the engine and the generator and the soundproof case accommodates the engine, the generator and other components of the unit therein. An interior of the soundproof case is partitioned into front, center and rear compartments by plate-like front and rear frame members; a through hole is formed in the rear frame member; a duct is provided in the through hole swelling out toward the center compartment and the rear compartment; the generator, the engine and a muffler are accommodated in the duct; a fuel tank and suction system instruments are disposed outside of the duct within the center compartment; and electric instruments are disposed within the front compartment.

13 Claims, 7 Drawing Sheets

ENGINE-OPERATED GENERATOR

BACKGROUND OF THE INVENTION

1. Field of the Invention

The present invention relates to an engine-operated generator covered by a soundproof case in its entirety.

2. Discussion of Relevant Art

The engine-operated generator in which an engine and a generator driven by the engine are integrated is used at a construction work site generally. And in consideration of influences to the surroundings when it is operated in a city area especially at night, an engine-operated generator covered by a soundproof case in its entirety has been used widely in order to restrain operation noise to as low a level as possible.

In this kind of engine-operated generator, openings for suctioning or discharging air are made few in number and small in size to achieve necessary low noise level during operation. But on the one hand, it is necessary to devote great care to cooling interior of the soundproof case because the area of the opening openings is small.

In an engine-operated generator disclosed in Japanese Utility Model Publication No. 2-5068, an interior of a soundproof case is partitioned into a suction compartment for housing an air-cleaner and a carburetor, a first heat source compartment for housing an engine and a muffler, a second heat source compartment for housing a generator and a silencer compartment to improve sound interrupting effect and cooling effect.

However, according to the above known construction, while high sound interrupting effect and cooling effect are obtainable, a ventilation construction is complicated because the above four compartments are intricate, and even if the cooling effect is high, the cooling efficiency itself is not necessarily high.

SUMMARY OF THE INVENTION

The present invention has been accomplished in view of the foregoing and one object of the invention is to provide a compact engine-operated generator unit in which instruments in a soundproof case are arranged efficiently from the viewpoint of measures for sound and heat abatement.

In order to attain the above object, the present invention provides an engine-operated generator unit comprising an engine and a generator driven by the engine arranged in a direction of a rotary shaft and accommodated in a soundproof case; a plate-like front frame member and a plate-like rear frame member partitioning an interior of the soundproof case into a front compartment, a center compartment and a rear compartment; a through hole formed in the rear frame member; a duct provided in communication with the through hole swelling out toward the center compartment and the rear compartment; the generator, the engine and a muffler are accommodated in the duct; a fuel tank and suction system instruments disposed outside of the duct within the center compartment; and electric instruments disposed within the front compartment.

According to the invention; the engine-operated generator unit has a simpler construction than the known construction; the generator, the engine and the muffler, which are sources of operation noise and heat, are accommodated in the duct such that these components are separated by the duct and the soundproof case doubly from the exterior; and heat generating instruments, fuel system instruments and electric instruments are each gathered and disposed separately and isolated from the others in such manner that on the outside of the duct not influenced by the high temperature heat, the fuel tank and the suction system instruments are accommodated in the center compartment and the electric instruments are accommodated in the front compartment. Therefore, each group of instruments can be disposed efficiently from the viewpoint of measures for sound and heat and the whole apparatus can be made compact easily.

Since the heat source instruments such as the generator, the engine and the muffler are concentrated in the same duct, cooling of these instruments can be carried out efficiently by ventilating the duct. As for the operation noise, since the noise sources such as the engine and the muffler are covered doubly by the duct and the soundproof case, a high sound interrupting effect can be obtained.

The engine-operated generator unit may have a suction hole formed in an outer wall of a front portion of the soundproof case defining the front compartment, a communication hole formed in the front frame member for connecting the front compartment with the center compartment, a suction opening of the duct opening into the center compartment, and a discharge opening of the duct opening to an exterior of the rear compartment. Outside air introduced in the front compartment through the suction hole enters the center compartment through the communication hole, is inhaled in the duct through the suction opening of the duct, cools the generator, the engine and the muffler in sequential order, and then is discharged through the discharge opening to the exterior of the case.

According to such engine-operated generator unit, the front compartment having the outer wall formed with the suction hole acts as a labyrinth duct for introducing outside air, which restrains leakage of suction noise occurring in the center compartment in addition to cooling the electric instruments.

The outside air introduced in the front compartment is inhaled in the center compartment through the communication hole, then in the duct through the suction opening thereof and cools firstly the generator of relatively low temperature, then the engine and the muffler of higher temperature in turn to be discharged through the discharge opening. Thus, an efficient cooling can be carried out by such simple ventilation construction.

A pair of right and left reinforcing members may be laid between upper portions of the front frame member and the rear frame member, and a fuel tank may be placed fixedly on the reinforcing members.

The fuel tank is disposed within the center compartment together with suction system instruments so that fuel system parts of the engine can be concentrated in the lump. In addition, a large-sized fuel tank can be disposed in an upper part of the center compartment compactly.

A control circuit unit may be disposed in an air passage extending from the suction hole formed in the outer wall of the front compartment to the communication hole of the front frame member.

The control circuit unit having to be restrained from temperature rise can be cooled efficiently in the front compartment where the outside air is introduced initially, separately from other less sensitive instruments.

BRIEF DESCRIPTION OF THE DRAWINGS

FIG. 2 is an exploded perspective view of a soundproof case and inner frame members there of;

DETAILED DESCRIPTION OF THE PREFERRED EMBODIMENT

Hereinafter, a preferred embodiment of the present invention will be described with reference to FIGS. 1 to 7.

Figure 1:
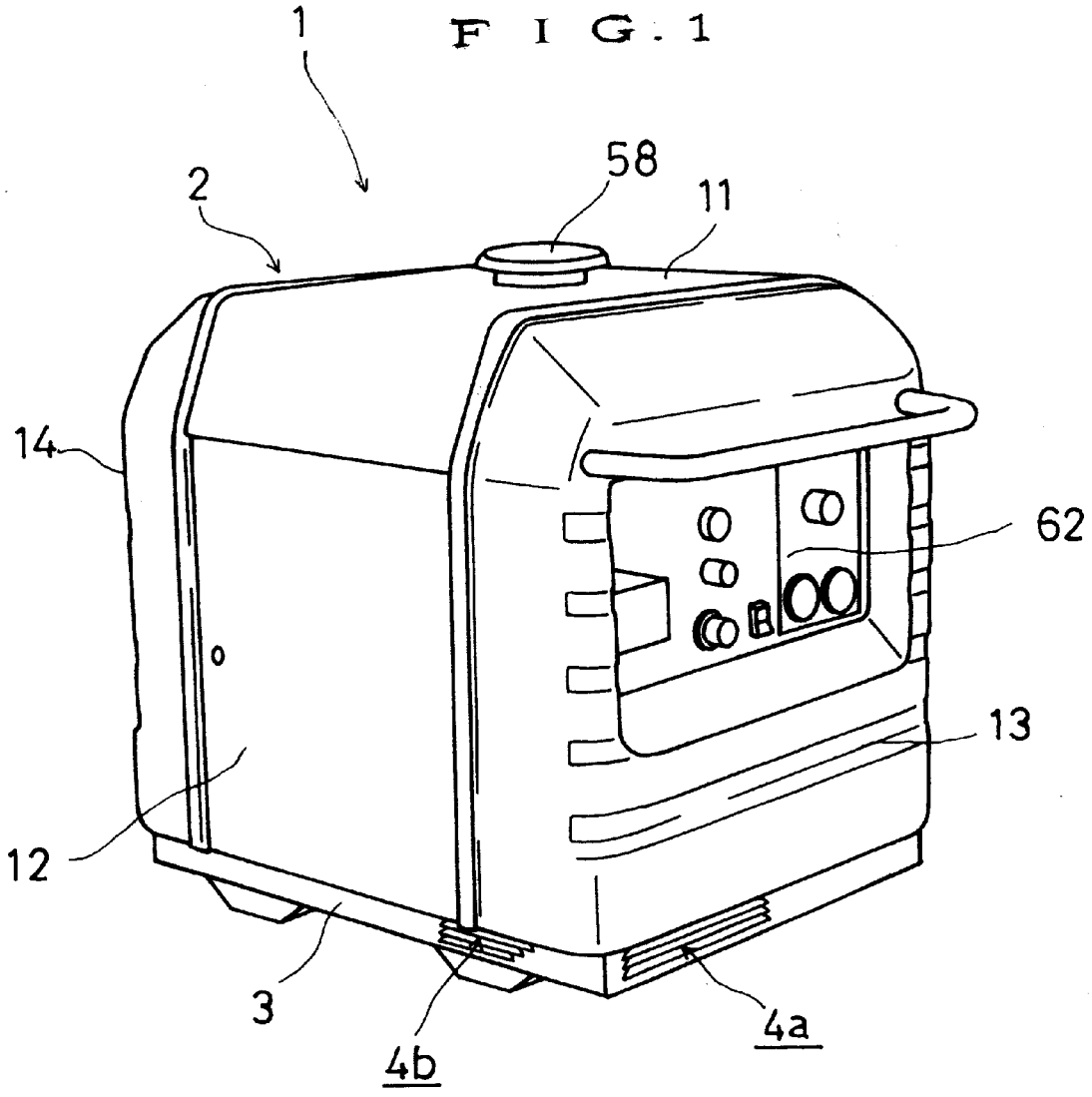
FIG. 1 is an perspective view of an engine-operated generator according to a preferred embodiment of the present invention.

The engine-operated generator 1 according to the preferred embodiment is covered with a soundproof case 2 in its entirety to form a cube as shown in FIG. 1.

Figure 2:
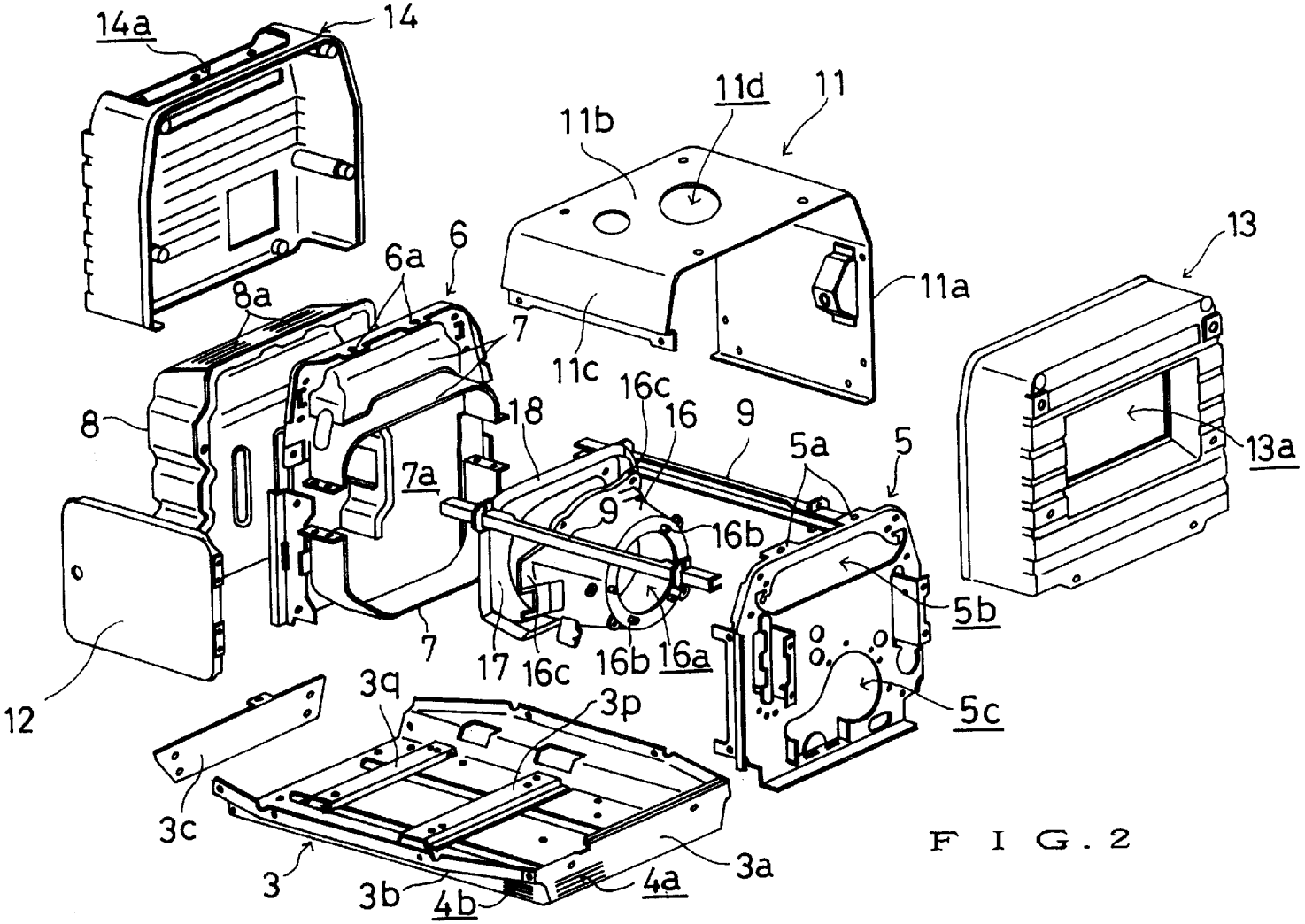

FIG. 2 is an exploded perspective view of the soundproof case 2 and other inner frame members. An under frame member 3 is formed in a shape of a flat saucer and has a front side wall 3*a*, a right side wall 3*b* and a rear side wall 3*c*. The front and right side walls 3*a*, 3*b* are provided with suction holes 4*a*, 4*b*. The rear side wall 3*c* is detachable. On the inner side of the under frame member 3 are laid a pair of front and rear supporting members 3*p*, 3*q* extending in the right-left direction in parallel with each other.

On the under frame member 3 are erected substantially rectangular front and rear frame members 5, 6 facing to each other at a predetermined interval.

Upper edge portions of the front frame member 5 are bent rearward to form flanges 5*a*. A rectangular panel portion of the front frame member 5 has a rectangular open hole 5*b* elongated in the right-left direction at an upper part and a communication hole 5*c* formed in a shape of a partly swelled circle at a lower part.

On the one hand, the rear frame member 6 is split into upper and lower parts and a large rectangular central through hole 7*a* is formed when the upper and lower parts are joined. From the through hole 7*a* is projected forward a duct 7 formed integrally with the rear frame member 6. Upper edge portions of the rear frame member 6 are bent forward to form flanges 6*a*. The front portion of the duct 7 is shaped in the form of a rectangular pipe opening to the front.

A duct 8 made of glass wool is disposed behind the rear frame member 6. The duct 8 swells out rearward communicating with the duct 7 through the through hole 7*a*. The duct 8 is also shaped as a substantially rectangular box opening toward the front and bottom and having a discharge hole 8*a* at an upper side wall.

Between the front frame member 5 and the rear frame member 6 erected on the under frame member 3, a pair of right and left reinforcing rails 9, 9 are provided directed in front-rear direction and penetrating upper corners of the frame members 5, 6.

A center cover 11 shaped as a halved square pipe is placed along outer peripheral edges of the front and rear frame members 5, 6 for covering the space between the frame members 5, 6 to partition the space from the exterior.

The center cover 11 is formed in a shape of a half of a square pipe by bending a plate and has a left side wall 11*a*, an upper wall 11*b* and a right upper side wall 11*c*. The right under side of the center cover 11 is covered by an opening and closing separate lid member 12 to partition a center compartment 22 (FIG. 3) therein. In the upper wall of the center cover 11 is formed a circular hole lid through which a refueling mouth 55*b* of a fuel tank 55 projects (FIG. 4).

A front of the front frame member 5 is covered by a front cover 13 generally shaped as a rectangular box to partition a front compartment 21. An under part of an outer wall of the front compartment is formed by the aforementioned front and rear side walls 3*a*, 3*b* of the under frame member 3. A rear of the rear frame member 6 is covered by a rear cover 14 also generally shaped as a rectangular box to partition a rear compartment 23. Along the inner surface of the rear cover 14 extends the aforementioned glass wool duct 8 as a liner. Therefore, the rear compartment 23 is formed inside of the duct 8.

A central portion of a front wall of the front cover 13 is recessed and there is formed a rectangular opening 13*a* for a control panel 62. In an upper wall of the rear cover 14 is formed a rectangular opening 14*a* corresponding to the discharge hole 8*a* provided on the aforementioned duct 8.

As mentioned above, the soundproof case 2 constituting an outer wall of the engine-operated generator 1 has six faces formed by the under frame member 3, the center cover 11, the lid member 12, the front cover 13 and the rear cover 14. And inner space of the soundproof case 2 is partitioned into the front compartment 21, the center compartment 22 and the rear compartment 23 by the front frame member 5 and the rear frame member 6.

In addition, within the center compartment is provided a fan cover 16, which serves as a duct too, continuously to the rectangular-pipe-like section of the duct 7 swelling out into the center compartment 22 from the rear frame member 6. The fan cover 16 is formed in a substantially cylindrical shape to cover a generator 35 and a centrifugal fan 40 and has a suction opening 16*a* which is a circular opening at the front end thereof. On a circular end surface at the suction opening 16*a* are provided a plurality of projections 16*b* having predetermined lengths.

The fan cover 16 has a flange 16*c* projecting radially outward at the rear end opening thereof and a rectangular frame member 17 is attached to the flange 16*c* from the rear. The rectangular frame member 17 is surrounded by a seal rubber 18 along the rectangular outer peripheral edge there of and fitted in the rectangular-pipe-like section of the duct 7 being sealed by the seal rubber 18.

Namely, the fan cover 16 is connected with the duct 7 of the rear frame member 6 through the rectangular frame member 17 and the duct 7 is connected with the duct 8 which swells out rearward from the rear frame member 6 to form the rear compartment 23.

Therefore, within the soundproof case 2, a duct space formed by the fan cover 16, the duct 7 and the duct 8 occupies the rear compartment 23 and a part of the center compartment 22. The duct space has an upper stream side suction opening 16*a* opening into the center compartment 22 and a lower stream side discharge opening 8*a* provided in the upper side wall of the duct 8. The discharge opening 8*a* faces the rectangular opening 14*a* of the rear cover 14 and opens to the exterior of the soundproof case 2.

On the above-mentioned frame construction and duct construction within the soundproof case 2 are disposed various instruments. The engine 30 is accommodated in the ducts 7, 8 at the rear of the soundproof case 2 as shown in FIG. 4, and supported by a pair of right and left vibrationproof mount members 31 fixed to the supporting member 3*q* on the under frame member 3 (FIGS. 4 and 6).

Figure 6:
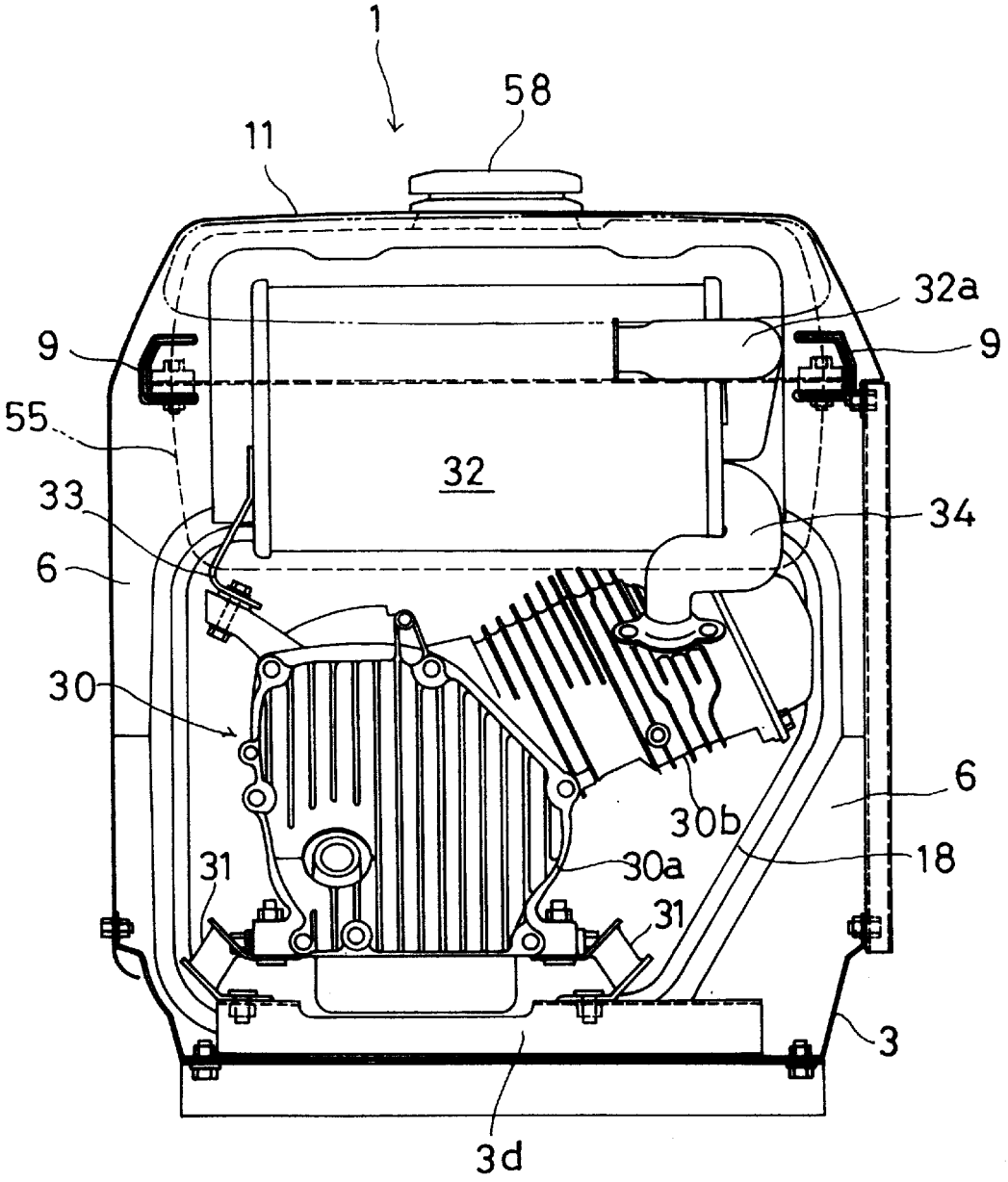
FIG. 6 is a rear view thereof.
Figure 7:
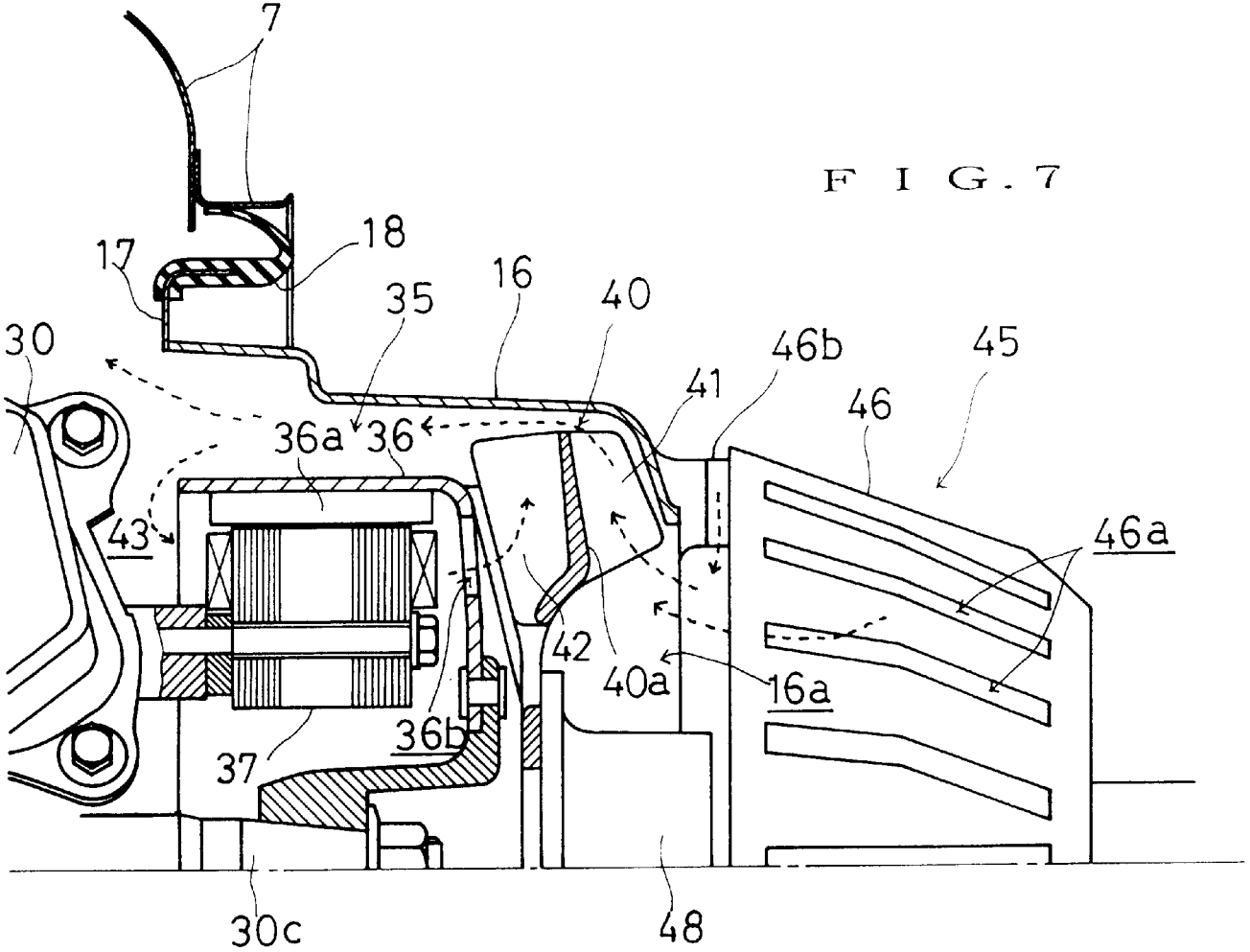
FIG. 7 is a partail side view showing partly by section the generator and vicinity thereof.

As shown in FIGS. 2, 6, 7, the engine 30 has a crankcase 30*a* positioned biased to the left side, a cylinder 30*b* projecting inclined to the right direction somewhat upwardly and a crankshaft 30*c* directed in front-rear direction horizontally and projecting forward.

Since the cylinder 30*b* of the engine 30 is inclined as mentioned above, a large upper space can be ensured in the ducts 7, 8, and in this space, a large cylindrical muffler 32 is disposed directed in right-left direction. The muffler 32 is supported by the engine by means of a bracket 33 and an exhaust pipe 34 extending upward from the cylinder 30*b* is connected with the muffler 32. A tail pipe 32*a* extends around the muffler 32 from a right side wall to a rear face thereof, and an exhaust opening of the tail pipe is positioned in the vicinity of the discharge opening 8*a*.

The generator 35 is connected to the crankshaft 30*c* projecting forward from the crankcase 30*a*. The generator 35 is an outer-rotor type multipolar generator having an outer-rotor 36 shaped in a bottomed cylinder fixed to the crankshaft 30*c* integrally. A plurality of magnets 36*a* are stuck circumferentially on an inner surface of a peripheral wall of the rotor 36 so as to rotate together with the crankshaft 30*c*. The outer-rotor 36 serves as a flywheel of the engine, too.

The outer-rotor 36 has a bottom wall at the front and opens rearward. As for the inner stator 37 of the generator 35, a stator core having a plurality of radial yokes and generating coils wound on the yokes is fixed to the crankcase 30*a*.

The bottom wall of the outer-rotor 36 is formed with a plurality of ventilating holes 36*b* and the centrifugal fan 40 is fixed to the bottom wall of the outer-rotor 36 from the front.

The centrifugal fan 40 is a two faces fan having fan blades 41, 42 on both front and rear faces of a disk-like base plate 40*a*. The fan cover 16 covers the generator 35 and the centrifugal fan 40 with the suction opening 16*a* at the front end opposed there of to the centrifugal fan 40. The rear end of the fan cover 16 is fixed to the crankcase 30*a* of the engine 30 together with the rectangular frame member 17.

In front of the fan cover 16, a recoil starter 45 is provided opposite to the suction opening 16*a*. A predetermined space is left between the recoil starter 45 and the fan cover 16 by the projections 16*b* on the end surface surrounding the suction opening 16*a* of the fan cover 16. A boss section 46*b* of a starter case 46 of the recoil starter 45 is fixed to the fan cover 16 to be supported integrally there with.

Figure 3:
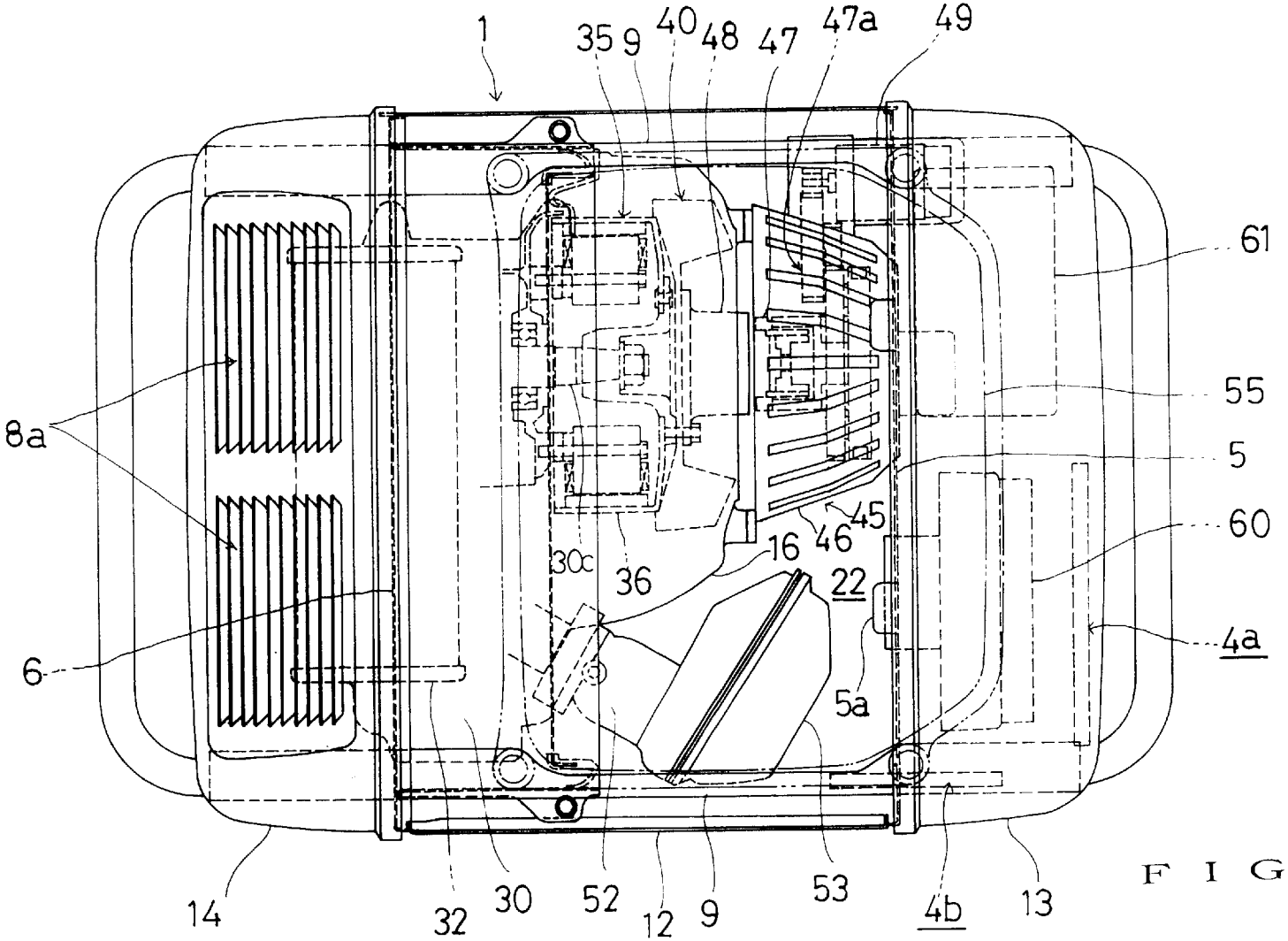
FIG. 3 is a plan view showing the engine-operated generator in which a center cover and a fuel tank are omitted to reveal inner details.
Figure 4:
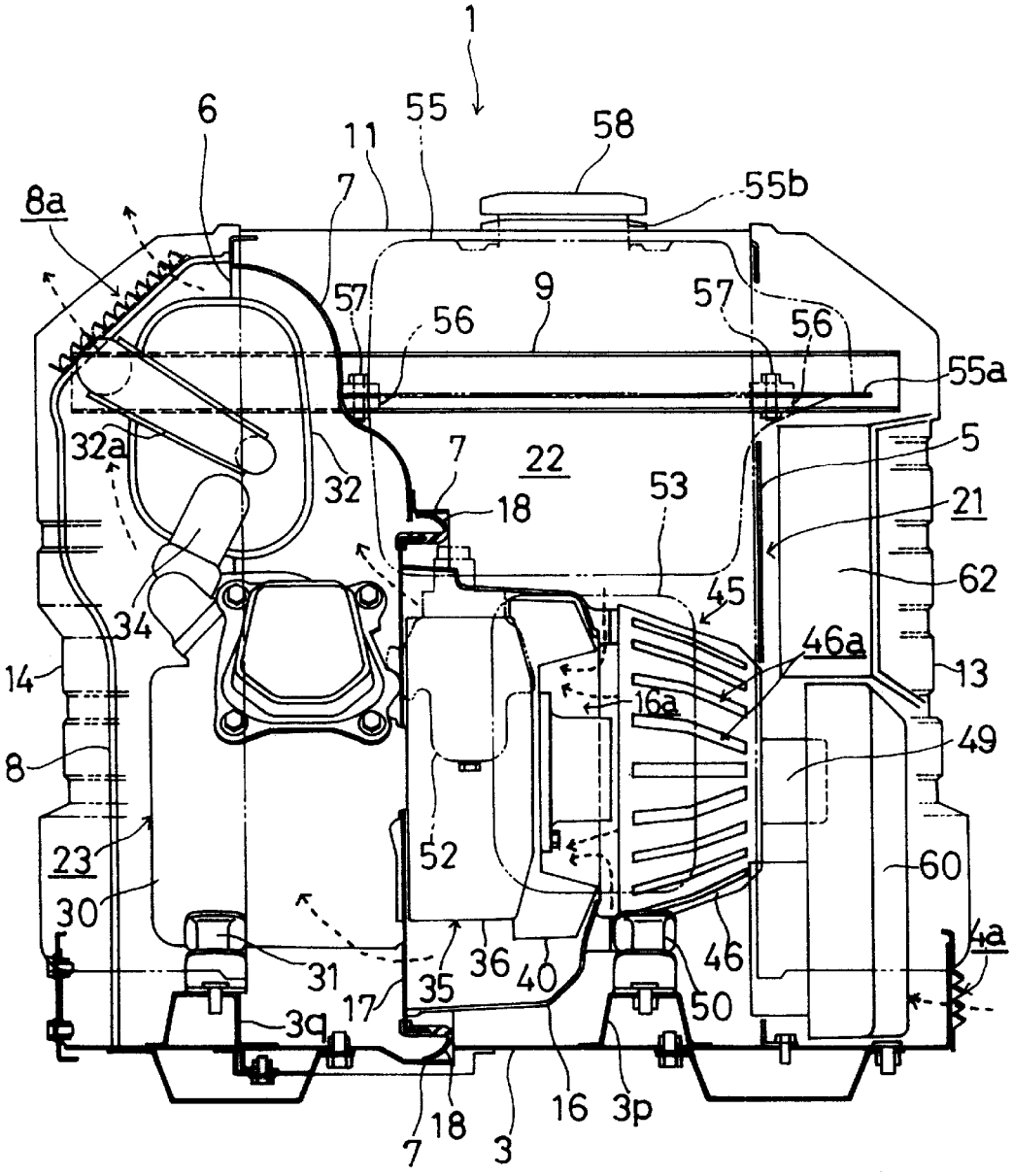
FIG. 4 is a side view of the engine-operated generator with some structure partly omitted.

Referring to FIG. 3, the recoil starter 45 has a ratchet wheel 47 provided on a rotary shaft which is coaxial with the crankshaft 30*c* so as to be projected rearward. A ratchet 48 opposing to the ratchet wheel 47 is attached to a central part of the centrifugal fan 40.

The ratchet wheel 47 is driven through a gear train 47*a* by a starter lever and also driven by a starter motor 49 provided at a left end of the starter case 46.

When the ratchet wheel 47, which is usually separated from the ratchet 48, is driven by the starter motor 49 for example, the ratchet wheel 47 projects rearward to engage with the ratchet 48 and the crankshaft 30*c* is rotated forcibly through the ratchet 48 and the outer-rotor 36 to start the engine 30.

The starter case 46 of the recoil starter 45 has a conical wall in which a plurality of slits 46*a* are formed arranged circumferentially. Cooling air is introduced into the suction opening 16*a* of the fan cover 16 through the space between the end face of the fan cover 16 and the starter case 46 and further through the slits 46*a*.

Figure 5:
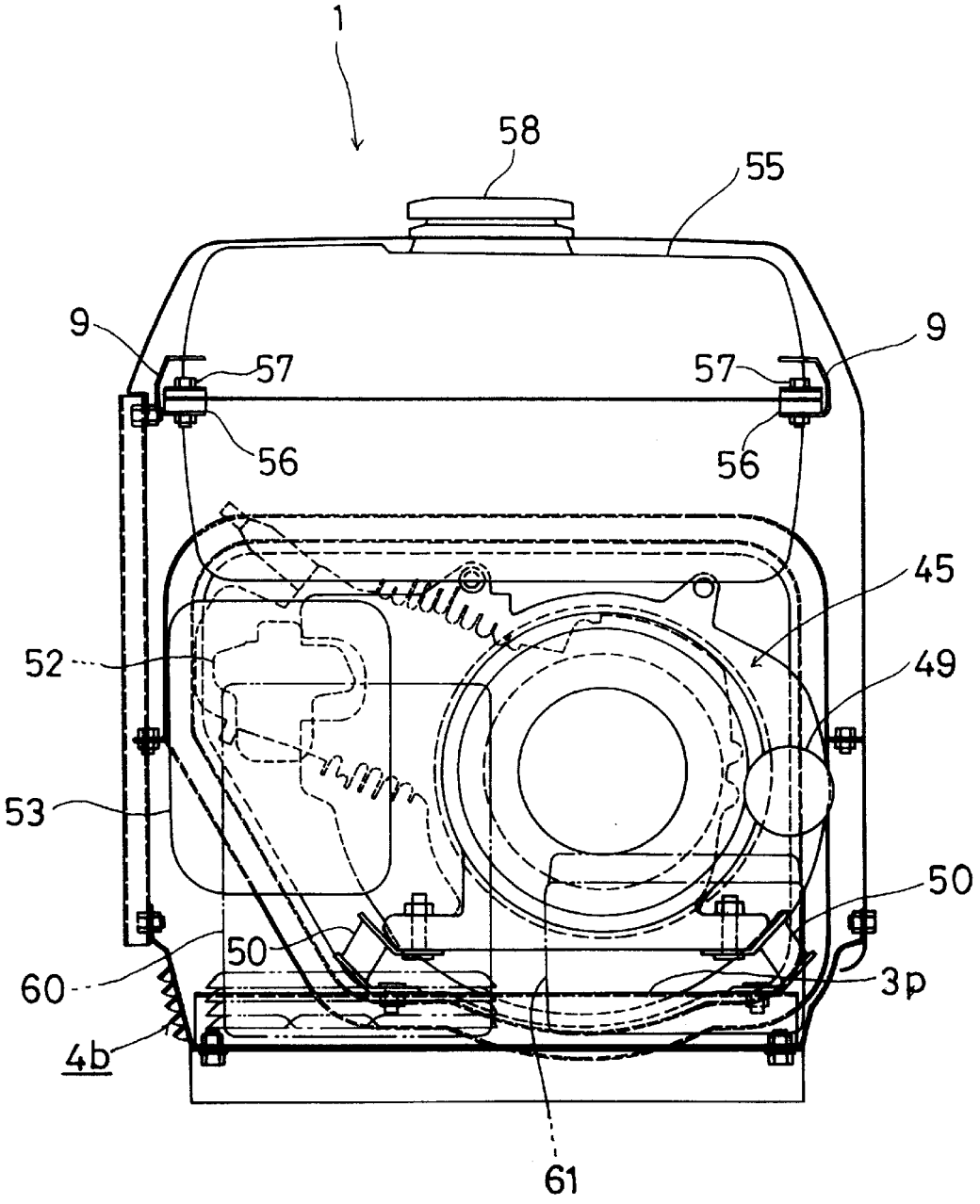
FIG. 5 is a front view thereof with some details shown in broken lines.

The recoil starter 45 is positioned in the center compartment 22 and supported by a pair of right and left vibrationproof mount members 50 fixed to the supporting member 3*p* on the under frame member 3 (FIGS. 4, 5).

The engine 30 and the recoil starter 45 are connected integrally by the fan cover 16 to constitute a vibratory unit. The engine 30 in the rear is supported by the vibrationproof mount members 31 and the recoil starter 45 in the front is supported by the vibrationproof mount members 50, so that the vibratory unit can be supported efficiently at positions near both the front and rear end portions thereof.

Since the generator 35 and the recoil starter 45 are disposed in front of the crankcase 30*a* positioned left extending over the rear compartment 23 and the center compartment 22, there is formed a space on the right side of the fan cover 16 and the recoil starter 45 in the center compartment 22, and in this space are arranged a carburetor 52 and an air-cleaner 53 with the air-cleaner 53 positioned in front.

While the muffler 32 is disposed above the engine 30, the fuel tank 55 is disposed in a space above the fan cover 16, the recoil starter 45, the carburetor 52 and the air-cleaner 53 in the center compartment 22.

The fuel tank 55 is supported on the right and left reinforcing rails 9 laid between the front frame member 5 and the rear frame member 6 by means of a flange 55*a* fixed to the rails 9 by bolts 57 with vibrationproof rubbers 56 inserted.

A part of the fuel tank 55 is extruded into the front compartment 21 through the upper open hole 5*b* of the front frame member 5. The refueling mouth 55*b* of the fuel tank 55 is projected upward through the circular hole lid of the center cover 11 and a fuel cap 58 is screwed on an upper end of the refueling mouth 55*b*.

The fuel tank 55 is disposed in a space outside of the fan cover 16 and the duct 7 within the center compartment together with suction system instruments such as the carburetor 52 and the air-cleaner 53, and fuel system parts of the engine 30 are concentrated in the lump. Thus, the space is utilized efficiently and the apparatus is made compact.

In the flat rectangular space of the front compartment 21 covered by the front cover 13 in front of the front frame member 5, an inverter device 60 and a battery 61 are disposed right and left on the under frame member 3 and above them is provided the control panel 62 facing the front rectangular opening 13*a* of the front cover 13. Namely, electric instruments are concentrated in the front compartment 21.

The inverter device 60 converts output of the multipolar generator 35 into alternating current of a predetermined frequency. The inverter device 60 is disposed on the right side of the front compartment 21 near the suction holes 4*a*, 4*b* to be cooled by sucked exterior air at the outset when the air is drawn into the soundproof case.

As described above, the engine-operated generator 1 having the soundproof case 2 is constructed in such a manner that the generator 35, the engine 30 and the muffler 32 are arranged in this order and accommodated in the ducts 7, 8 and the fan cover 16.

The suction opening 16*a* of the fan cover 16 opens into the center compartment 22 and the centrifugal fan 40 is provided inside of the suction opening 16*a*, so that by rotation of the centrifugal fan 40, air is introduced into the center compartment 22 through the front compartment 21 from outside of the soundproof case 2 and inhaled in the fan cover 16 through the slits 46*b* in the starter case 46 of the recoil starter 45, the space between the fan cover 16 and the starter case 46, and the suction opening 16*a* (streams of the air are shown by arrows of dotted line in FIGS. 4 and 7).

As shown in FIG. 7, air inhaled in the fan cover 16 through the suction opening 16*a* by the fan blade 41 on the front face of the centrifugal fan 40 flows along the inner peripheral surface of the fan cover 16 and the outside of the outer-rotor 36 of the generator 35 toward the engine 30 to cool the engine. However, a part of the air flowing toward the engine 30 is directed to the inside of the outer-rotor 36 through a space between the generator 35 and the engine 30 by action of the fan blade 42 on the rear face of the centrifugal fan 40 to cool the generating coil and returns to the centrifugal fan 42 through the ventilating holes 36*b* in the bottom wall of the outer-rotor 36 for recirculation.

The air introduced to the engine 30, including the above-mentioned recirculated air cools the engine and then flows upward guided by the ducts 7, 8 to cool the muffler 32 (FIG. 4). After cooling the muffler 32, the air is discharged to the exterior of the case 2 through the discharge opening 8*a* of the soundproof case 2 positioned above the muffler facing the exterior.

Since the center compartment 22 communicates with the front compartment 21 through the communication hole 5*c* of the front frame member 5, air introduced from the exterior through the suction holes 4*a*, 4*b* into the front compartment 21 is inhaled into the center compartment 22. At that time, the front compartment 21 acts as a labyrinth duct for introducing exterior air which restrains leakage of suction noise occurring in the center compartment 22. The inverter device 60 is positioned in the course of the suction air stream from the suction holes 4*a*, 4*b* so as to be cooled effectively.

The generator 35, the engine 30 and the muffler 32 which are heat sources are covered by the fan cover 16 and the ducts 7, 8 to be isolated from other instruments, and the air inhaled in the fan cover 16 by the centrifugal fan 40 through the suction opening 16*a* opening into the center compartment 22 initially cools the generator 35 of relatively low temperature and then the engine 30 and the muffler 32 of higher temperature and is then discharged to the exterior through the discharge opening 8*a*. Therefore, an efficient cooling can be carried out.

Since the centrifugal fan 40 is attached to the outer-rotor 36 of the generator 30, the cooling fan 40 of large capacity can be furnished and a high fan supporting strength can be obtained.

Since the muffler 32 is disposed above the engine 30 in such a manner that the hotter instrument is positioned at the higher position and the discharge opening 8*a* is provided above the muffler 32, a reasonable cooling air stream can be generated for efficient cooling.

The engine-operated generator 1 has a simple construction in that the interior of the soundproof case 2 is partitioned into three compartments by the front frame member 5 and the rear frame member 6, and the ducts 7, 8 are provided in the through hole 7*a* of the rear frame member 6. The generator 35, the engine 30 and the muffler 32 which are sources of operation noise and heat, are accommodated in the ducts 7, 8 and the fan cover 16 thereby being separated doubly from the exterior. Heat generating instruments, fuel system instruments and electric instruments are each gathered separately and disposed within the case 2 so as to be isolated from each other. Particularly, on the outside of the duct 7 and the fan cover 16, which is an area not influenced by the high temperature heat, suction system instruments including the carburetor 52 and the air-cleaner 53 and fuel system instruments including the fuel tank 55 are accommodated in the center compartment, and electric instruments including the inverter device 60, the control panel 62 and the battery 61 are accommodated in the front compartment. Therefore, each of the engine-operated generator unit can be disposed efficiently from the viewpoint of measures for sound and heat and the whole apparatus can be made compact easily.

Although there has been described in detail above what is considered to be the presently preferred embodiment of the invention, it will be understood by persons skilled in the art that variations and modifications may be made thereto without departing from the spirit, gist or essence of the invention. The scope of the invention is indicated by the appended claims.

What is claimed is:

1. An engine-operated generator unit comprising: an engine and a generator driven by the engine arranged in a direction of a rotary shaft linking the engine and the generator;

a soundproof case accommodating the engine, the generator and other components of the unit therein;

a plate-like front frame member and a plate-like rear frame member partitioning an interior of said soundproof case into a front compartment, a center compartment and a rear compartment;

a through hole formed in said rear frame member;

a duct provided in communication with said through hole swelling out toward said center compartment and said rear compartment;

said generator, said engine and a muffler being accommodated in said duct;

a fuel tank and suction system instruments disposed outside of said duct within said center compartment; and electric instruments disposed within said front compartment;

a suction hole being formed in an outer wall of said front compartment;

a communication hole being formed in said front frame member for communicating said front compartment with said center compartment;

a suction opening of said duct opening into said center compartment; and a discharge opening of said duct opening to an exterior of said rear compartment, whereby outside air introduced into said front compartment through said suction hole enters said center compartment through said communication hole, is inhaled into said duct through said suction opening of said duct, sequentially cools said generator, said engine and said muffler in order, and then is discharged through said discharge opening to the exterior.

2. An engine-operated generator unit as claimed in claim 1, having a pair of right and left reinforcing members laid between upper portions of said front frame member and said rear frame member; and a fuel tank fixedly placed on said reinforcing members.

3. An engine-operated generator unit as claimed in claim 2, having a control circuit unit disposed in an air passage extending from said suction hole formed in the outer wall of said front compartment to said communication hole of said front frame member.

4. An engine-operated generator unit as claimed in claim 1, having a control circuit unit disposed in an air passage extending from said suction hole formed in the outer wall of said front compartment to said communication hole of said front frame member.

5. An engine-operated generator unit comprising:

an engine having an output rotary shaft;

a generator operatively connected to said engine for being driven thereby, and having a longitudinal axis extending coaxially with the rotary shaft;

a soundproof case housing the engine, the generator, and other components of the engine-operated generator unit therein;

frame means for partitioning an interior of said soundproof case into a front compartment, a center compartment and a rear compartment, a rear portion of said frame means having a through hole formed therein;

duct means provided within said soundproof case in communication with said through hole, and swelling out toward said center compartment and said rear compartment;

said generator, said engine and a muffler being disposed within said duct means;

said duct means channeling cooling air within the soundproof case sequentially to said generator, said engine, and said muffler;

a fuel tank and suction system instruments disposed outside of said duct means within said center compartment; and electric instruments disposed within said front compartment.

6. An engine-operated generator unit as claimed in claim 5, wherein a suction hole is formed in an outer wall of said soundproof case defining the front compartment; a communication hole is formed in a front portion of said frame means for communicating said front compartment with said center compartment; said duct means having a suction opening which opens into said center compartment and a discharge opening which opens to an exterior of said rear compartment, whereby outside air introduced into said front compartment through said suction hole enters said center compartment through said communication hole, is inhaled into said duct means through said suction opening, sequentially cools said generator, said engine and said muffler in order, and then is discharged through said discharge opening to the exterior of the rear compartment.

7. An engine-operated generator unit according to claim 6, wherein said frame means, said duct means and said suction hole formed in the outer wall of the front compartment jointly define a labyrinth passage for introducing the outside air into said duct means, and for restraining leakage from the unit of suction noise occurring in the central compartment.

8. An engine-operated generator unit as claimed in claim 6, wherein said electric instruments include a control circuit unit disposed in an air passage extending from said suction hole to said communication hole of the front portion of said frame means.

9. An engine-operated generator unit as claimed in claim 5, further including a pair of right and left reinforcing members laid between upper portions of said frame means, and a fuel tank fixed to said reinforcing members.

10. An engine-operated generator unit according to claim 5, wherein said frame means includes a plate-like front frame member and a plate-like rear frame member, each extending vertically within said soundproof case.

11. An engine-operated generator unit according to claim 5, wherein said duct means includes a cover member covering said generator, a first duct extending from a rear portion of said frame means into said center compartment, and a second duct extending from the rear portion of the frame means into the rear compartment.

12. An engine-operated generator unit as claimed in claim 5, wherein a single cooling air passage is defined in said soundproof case extending into the front compartment, then into the center compartment, through the duct means into the rear compartment from which the cooling air is discharged.

13. An engine-operated generator as claimed in claim 12, further including a single cooling fan associated with said cooling passage.

* * * * *

UNITED STATES PATENT AND TRADEMARK OFFICE

CERTIFICATE OF CORRECTION

PATENT NO : 6,039,009

DATED : 21 March 2000

INVENTOR(S) : Tadafumi Hirose

It is certified that error appears in the above-identified patent and that said Letters Patent is hereby corrected as shown below:

On the cover page, under "[56] References Cited", for U.S. Patent Document 5,642,702 change "Konchi" to --Kouchi--;

under "*Attorney, Agent, or Firm*", before "William D. Blackman" insert --Joseph P. Carrier;--.

Column 1, line 22, change "opening openings" to --openings--;
line 60, change the semicolon to a colon.

Column 3, line 2, change "there of" to --thereof--;
11th line, change "partail" to --partial--.

Column 4, line 4, change "lid" to --11*d*--;
lines 44-45, change "there of" to --thereof--.

Column 5, line 8, after "space" delete the comma;
37th line, change "opposed there of" to --thereof opposed--;
46th line, change "there with" to --therewith--.

Column 6, line 33, change "lid" to --11*d*--.

Column 7, line 18, after "air" insert a comma;
line 61, after "16" insert a comma.

Column 8, line 6, after "each" insert --instrument--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*